US010431398B2

(12) United States Patent
Jameson et al.

(10) Patent No.: US 10,431,398 B2
(45) Date of Patent: Oct. 1, 2019

(54) SWIVEL CATCH APPARATUS, ENCLOSED SWITCH ASSEMBLIES, AND OPERATIONAL METHODS THEREOF

(71) Applicant: Siemens Industry, Inc., Alpharetta, GA (US)

(72) Inventors: Thomas Jameson, Bellefontaine, OH (US); Dan A. Fisher, Dublin, OH (US)

(73) Assignee: SIEMENS INDUSTRY, INC., Alphartetta, GA (US)

( * ) Notice: Subject to any disclaimer, the term of this patent is extended or adjusted under 35 U.S.C. 154(b) by 40 days.

(21) Appl. No.: 15/701,973

(22) Filed: Sep. 12, 2017

(65) Prior Publication Data

US 2019/0080859 A1 Mar. 14, 2019

(51) Int. Cl.

| | |
|---|---|
| ***H01H 9/20*** | (2006.01) |
| *H01H 21/06* | (2006.01) |
| *H01H 9/02* | (2006.01) |

(52) U.S. Cl.

CPC ..... *H01H 9/20* (2013.01); *H01H 9/02* (2013.01); *H01H 21/06* (2013.01)

(58) Field of Classification Search

CPC ..... H01H 9/20; H01H 9/02; H01H 21/06
USPC ..... 200/50.15
See application file for complete search history.

(56) References Cited

U.S. PATENT DOCUMENTS

| | | | | | |
|---|---|---|---|---|---|
| 2,134,986 | A | | 11/1938 | Rach | |
| 2,332,633 | A | | 10/1943 | Green | |
| 3,240,888 | A | * | 3/1966 | Rys | H01H 9/10 200/50.15 |
| 3,629,536 | A | * | 12/1971 | Rys | H01H 9/04 200/294 |
| 4,194,100 | A | * | 3/1980 | Cox | H01H 9/22 200/50.15 |
| 5,053,590 | A | * | 10/1991 | Vierling | H01H 9/02 200/293 |

* cited by examiner

*Primary Examiner* — Edwin A. Leon
*Assistant Examiner* — Iman Malakooti

(57) ABSTRACT

A switch box mechanism of an enclosed switch assembly. The switch box mechanism includes a swivel catch having an elongated body, a pivot configured to allow the swivel catch to rotate relative to an enclosure, and a catch end including a catch configured to engage with an enclosure lid, and a slide feature formed in the elongated body, a rod configured to couple to a switch engagement member that is configured to engage with a rotor of a line base assembly, the rod having a slide portion slidably engaged with the slide feature, and a spring configured to bias the swivel catch. Enclosed switch assemblies and switch subassemblies including the switch box mechanism, and methods of operating enclosed switch assemblies are disclosed, as are other aspects.

18 Claims, 9 Drawing Sheets

SWIVEL CATCH APPARATUS, ENCLOSED SWITCH ASSEMBLIES, AND OPERATIONAL METHODS THEREOF

FIELD

The present disclosure relates to switch assemblies and components thereof for electrical power switching, and in particular to handle-operated switch assemblies for enclosures.

BACKGROUND

Conventional enclosed switch assemblies include a mountable enclosure and a line base assembly therein. The line base assembly includes a line base that mounts inside of the enclosure, and a moveable electrical engagement member (e.g., a rotor) that is rotatably mounted to the line base. The moveable electrical engagement member may include switch components (e.g., blades or other electrical contacts) for each phase (e.g., 3-phases). An external handle is connected to the moveable electrical engagement member (e.g., a rotor) through the wall of the enclosure and rotation thereof causes engagement and disengagement of the electrical switch. A swivel mechanism may be used to provide spring bias to ensure quick-make and quick-break (QMQB) functionality, such as specified by Underwriters Laboratories (e.g., UL 98.6.3.10) for enclosed switches of greater than 250V/30 A. The QMQB function opens or closes the switch after a designed rotation of the handle and the operator is incapable of retraining the opening or closing once that designed rotation has been met. The enclosure of enclosed switch assemblies may also include a spring-loaded lid catch mechanism, typically located at a bottom of the lid of the enclosure.

Such enclosed switch assemblies tend to be costly due to the large numbers of components used therein. Therefore, enclosed switch assemblies that have lower cost, which are simpler, and have fewer components are desired.

SUMMARY

According to a first aspect, a switch box mechanism of an enclosed switch assembly is provided. The switch box mechanism includes a swivel catch having an elongated body, a pivot configured to allow the swivel catch to rotate, and a catch end, the catch end including a catch configured to engage with a lid, and a slide feature formed in the elongated body, a rod including a first end configured to couple to a switch engagement member that is configured to engage with a rotor of a line base assembly, and a second end the rod slidably engaged with the slide feature, and a spring configured to bias the swivel catch.

According to another aspect, a switch subassembly is provided. The switch subassembly includes a line base assembly including a line base, and a rotor received in the line base and configured to be rotatable therein, the rotor including one or more electrical switch components; and a switch box mechanism, including: a switch engagement member configured to engage with the rotor of the line base assembly, a swivel catch having an elongated body, a pivot configured to allow the swivel catch to rotate, and a catch end, the catch end including a catch configured to engage with a lid of an enclosure, and a slide feature formed on the elongated body, a rod including a first end coupled to the switch engagement member, and a slide portion received in the slide feature, and a spring biasing the switch engagement member, the spring further biasing the swivel catch to a closed catch orientation. The spring bias enables quick-make and quick-break in some embodiments.

According to yet another aspect, an enclosed switch assembly is provided. The enclosed switch assembly includes an enclosure including an enclosure body and a lid on the enclosure body; and a switch subassembly mounted to the enclosure body, the switch subassembly comprising: a line base assembly including a line base coupled to the enclosure body, and a rotor received in the line base and configured to be rotatable therein, the rotor including one or more electrical switch components; a switch box mechanism, including: a switch engagement member configured to engage with the rotor, a swivel catch having an elongated body, a pivot configured to allow the swivel catch to rotate relative to the enclosure, and a catch end including a catch configured to engage with the lid, and a slide feature formed on the elongated body, a rod including a first end coupled to the switch engagement member, and a slide portion received in the slide feature, and a spring biasing the switch engagement member, the spring further biasing the swivel catch to a closed catch orientation wherein the catch engages the lid.

According to a method aspect, a method of operating an enclosed switch assembly is provided. The method includes providing a switch box mechanism, including a switch engagement member configured to engage a rotor of the enclosed switch assembly, a swivel catch including a pivot configured to allow rotation relative to an enclosure of the enclosed switch assembly, a catch configured to engage with a lid of the enclosure, and a slide feature, a rod including a first end coupled to the switch engagement member and a slide portion received in the slide feature, and a spring; spring biasing the switch engagement member with the spring relative to the swivel catch; and spring biasing the swivel catch with the spring to a closed catch orientation wherein the catch engages the lid.

Still other aspects, features, and advantages of the present disclosure may be readily apparent from the following description by illustrating a number of example embodiments, including the best mode contemplated for carrying out the present invention. The present disclosure may also be capable of other and different embodiments, and its several details may be modified in various respects, all without departing from the substance and scope of the present disclosure. Accordingly, the drawings and descriptions are to be regarded as illustrative in nature, and not as restrictive. The drawings are not necessarily drawn to scale. The disclosure covers all modifications, equivalents, and alternatives falling within the scope of the claims.

DETAILED DESCRIPTION

Figure 1:
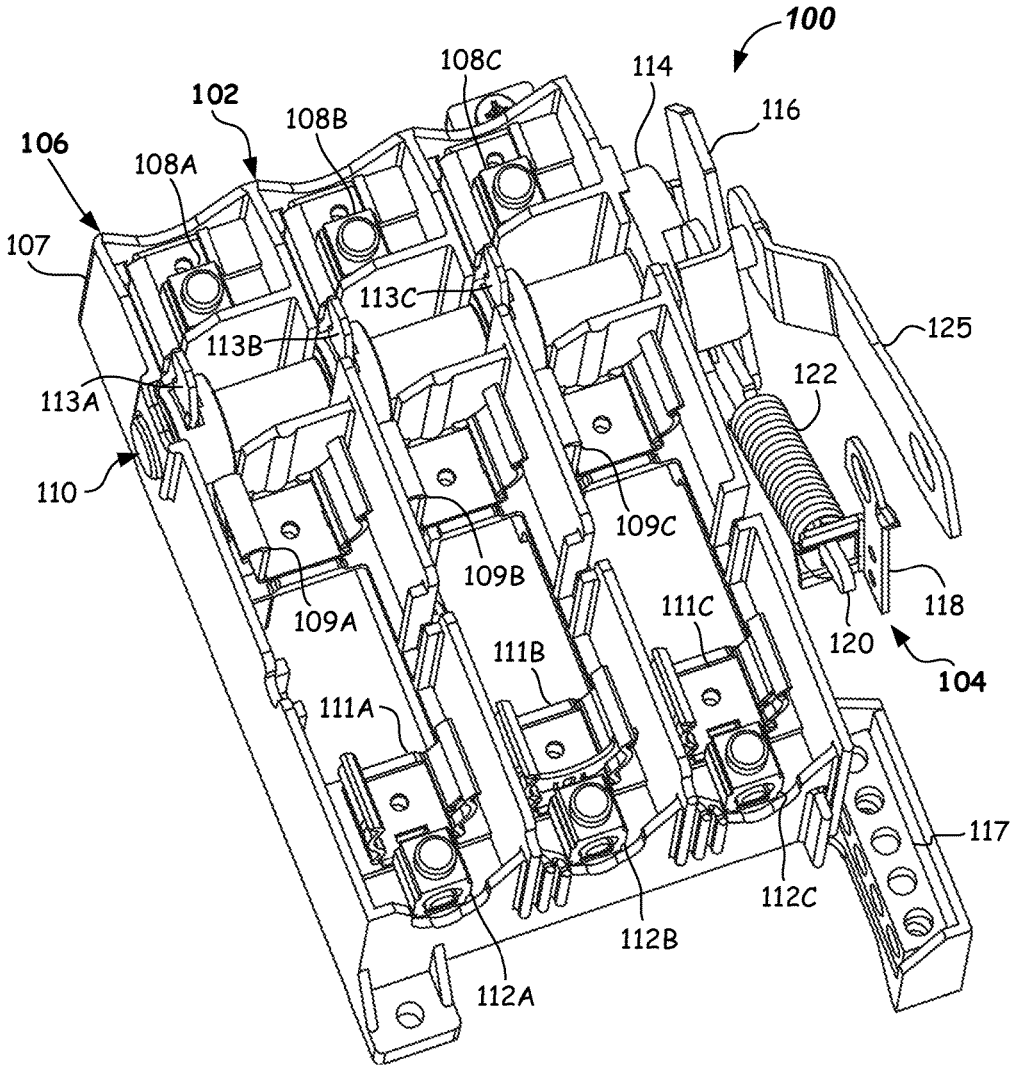
FIG. 1 illustrates a front perspective view of a switch subassembly including switch box mechanism according to one or more embodiments.
Figure 2A:
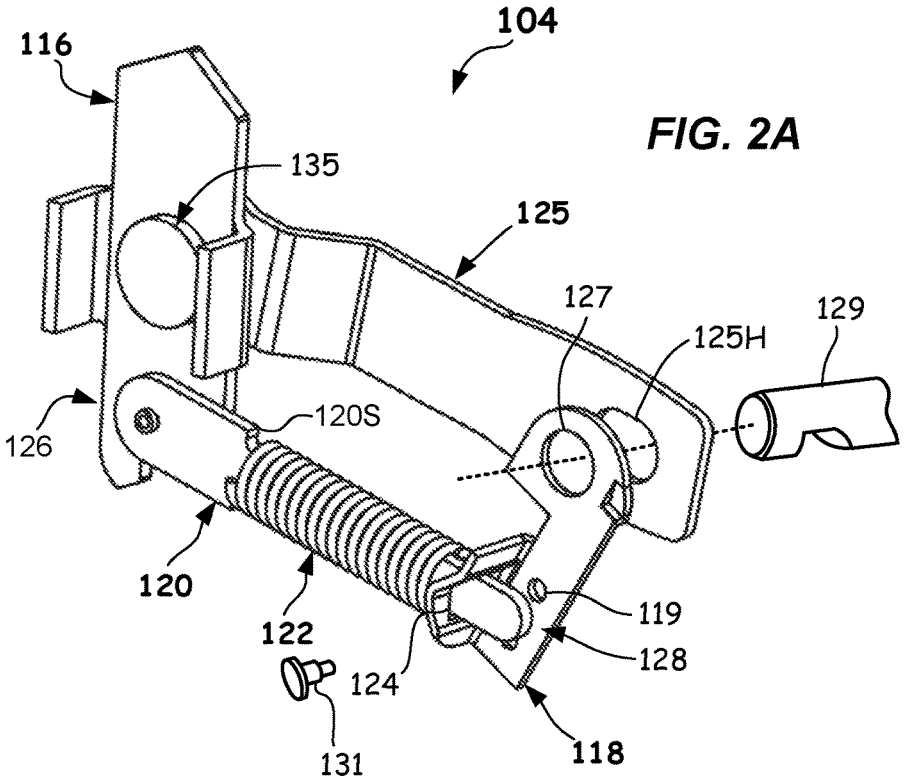
FIGS. 2A and 2B illustrate opposing perspective views of the switch box mechanism according to one or more embodiments.
Figure 2B:
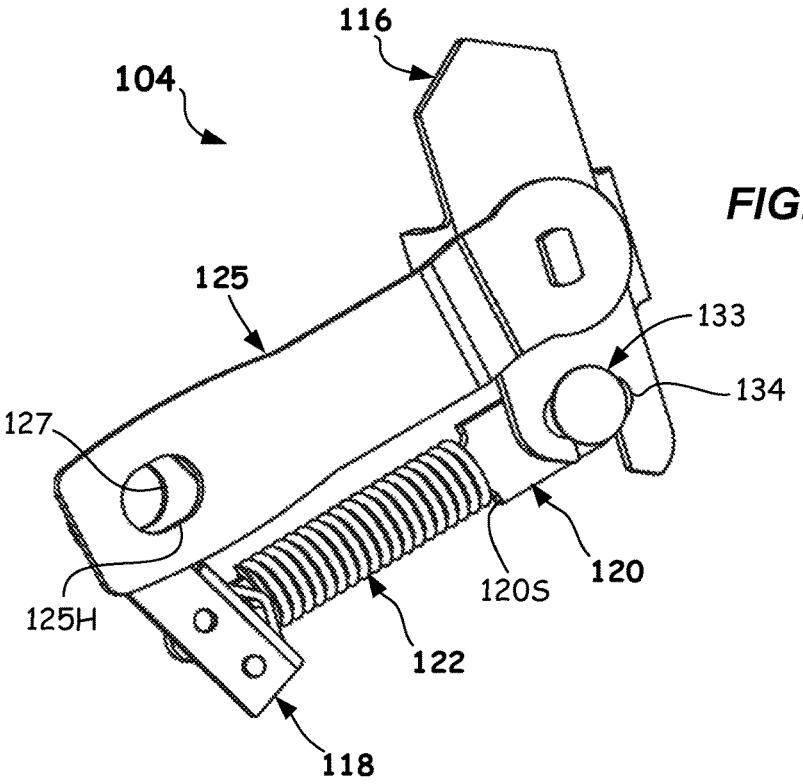

Reference will now be made in detail to the various embodiments of this disclosure, examples of which are illustrated in the accompanying drawings. Wherever possible, the same reference numbers will be used throughout the drawings to refer to the same or like parts.

Conventional enclosed switch assemblies provide electrical switching and include a box-like enclosure including a pivotable and/or removable lid. An operating handle external to the enclosure is used to open and close the switch provided therein. The operating handle should be capable of being locked out, so that the electrical contacts of the switch cannot be inadvertently closed when a connected circuit is being maintained/serviced. For example, UL UL98: 6.3.7 states there shall be provision for locking an enclosed switch in the off position without opening the enclosure.

Furthermore, such switch assemblies benefit from being configured to provide quick-make and quick-break (hereinafter QMQB). In particular, under UL 98.6.3.10, enclosed switches rated greater than 250V, 30 A shall have a design of the operating mechanism in conjunction with the contact structure, such that in normal operation, the operator of the switch cannot restrain the operation of the contacts after they have initially touched or parted when closing or opening the switch. Such operating mechanisms have been spring-biased to enable this QMQB functionality. However, such systems may tend to be bulky and complicated and include a large number of components.

The aforementioned problems of enclosed switch assemblies are overcome by one or more embodiments of the present disclosure. In particular, in some embodiments, an improved switch box mechanism is provided. Moreover, an enclosed switch assembly including an improved switch box mechanism is provided. The switch box mechanism is a mechanism that engages the electrical contact engagement member (e.g., rotor) of the switch to enable opening and closing of the switch. In one or more embodiments, the switch box mechanism comprises a swivel catch having an elongated body and a pivot configured to allow the swivel catch to rotate, such as relative to an enclosure body of an enclosure. A catch end of the swivel catch includes a catch configured to engage with a portion of lid (e.g., with a slot formed therein) of the enclosure thereby retaining the lid in a closed lid configuration (i.e., keeping the lid from opening without manual manipulation of the catch by the operator, and especially during arcing events where gas pressure may be built up in the enclosure). The swivel catch further includes a slide feature formed in the elongated body. A rod has a first end configured to rotatably couple to a switch engagement member of the switch box mechanism, and a second end of the rod is enageable with the slide feature. A spring biases the swivel catch to cause the catch to be provided in the closed lid configuration (in a configuration where the catch engages with the lid and retains it in a closed condition).

The switch engagement member is configured to engage with a rotor of a line base assembly installed within in the enclosure, and the spring further operates to spring bias the switch engagement member, which may provide the QMQB function or simply a spring bias. However, in some embodiments, the switch box mechanism is configured to provide both of the QMQB function (or spring bias of the switch engagement member) and also a lid catch/retention feature, all in one mechanism. Furthermore, the switch box mechanism may allow lock-out of the operating handle of the enclosed switch assembly, wherein the operating handle and the swivel catch may be secured together with a suitable locking member (e.g., a lock or tag) such that the switch is prevented from closing. Described embodiments are directed at switch box mechanisms for use with certain types of enclosed switch assemblies having a switch contained within an enclosure, wherein the enclosure includes a lid and an operating handle. However, as will be apparent from the following, the switch box mechanism may be beneficial in other types of enclosed switching devices.

Embodiments of the disclosure will be explained in greater detail with reference to FIGS. 1-6 herein.

Figure 4A:
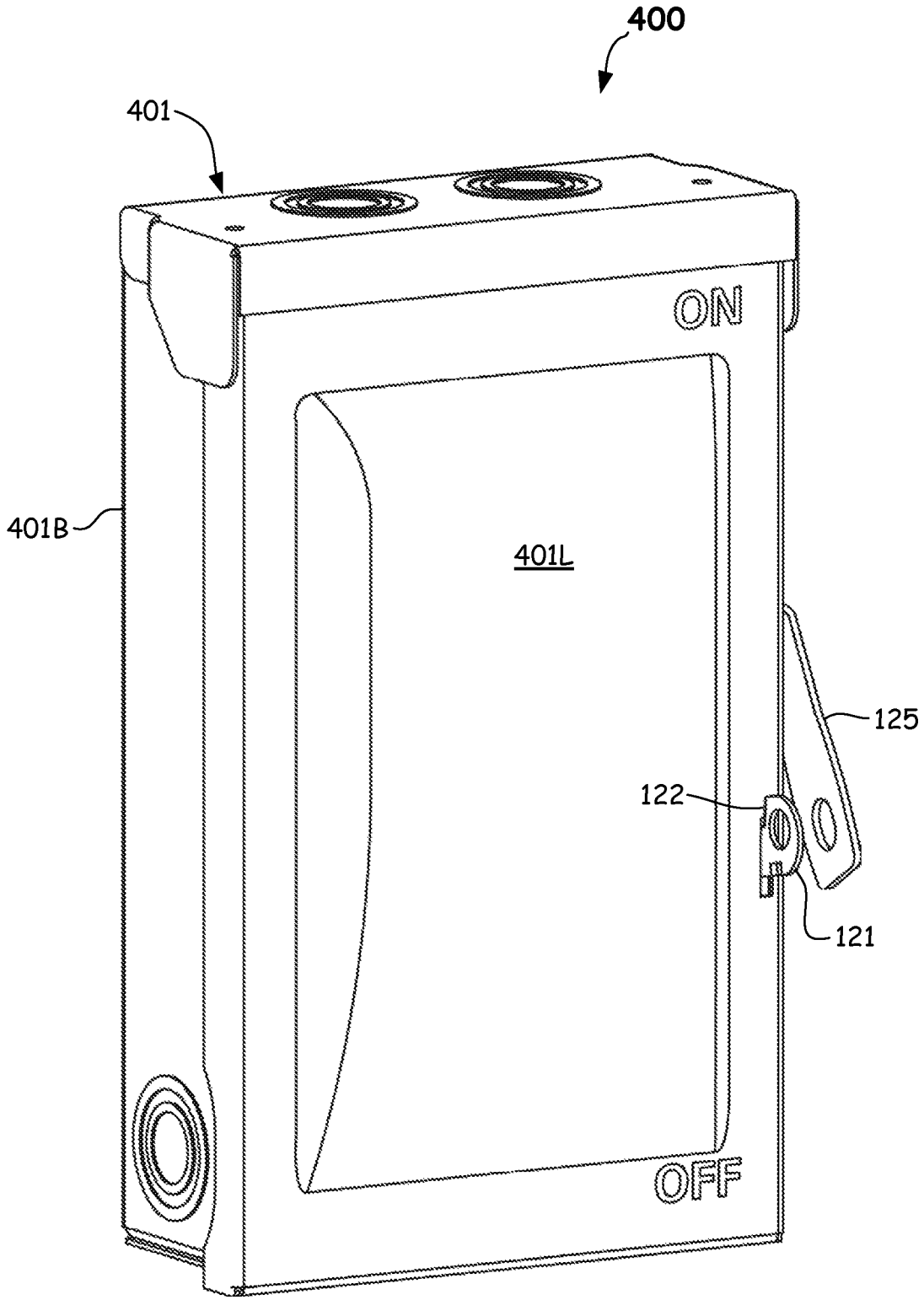
FIG. 4A illustrates a perspective view of an enclosed switch assembly with the lid closed and the operating handle aligned with the catch enabling a lock-out configuration according to one or more embodiments.
Figure 4B:
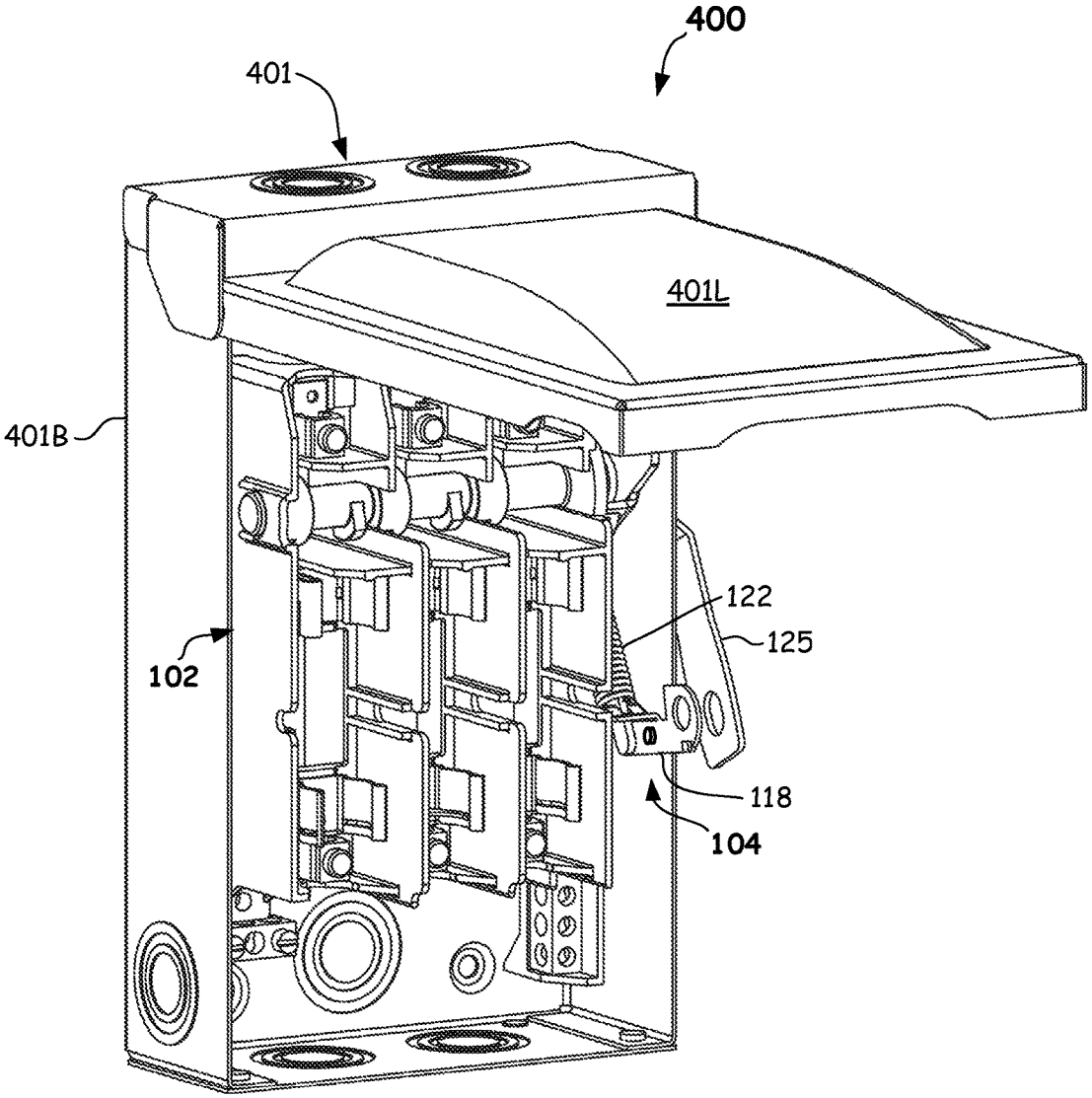
FIG. 4B illustrates a perspective view of an enclosed switch assembly with the lid opened illustrating the switch subassembly according to one or more embodiments.
Figure 4C:
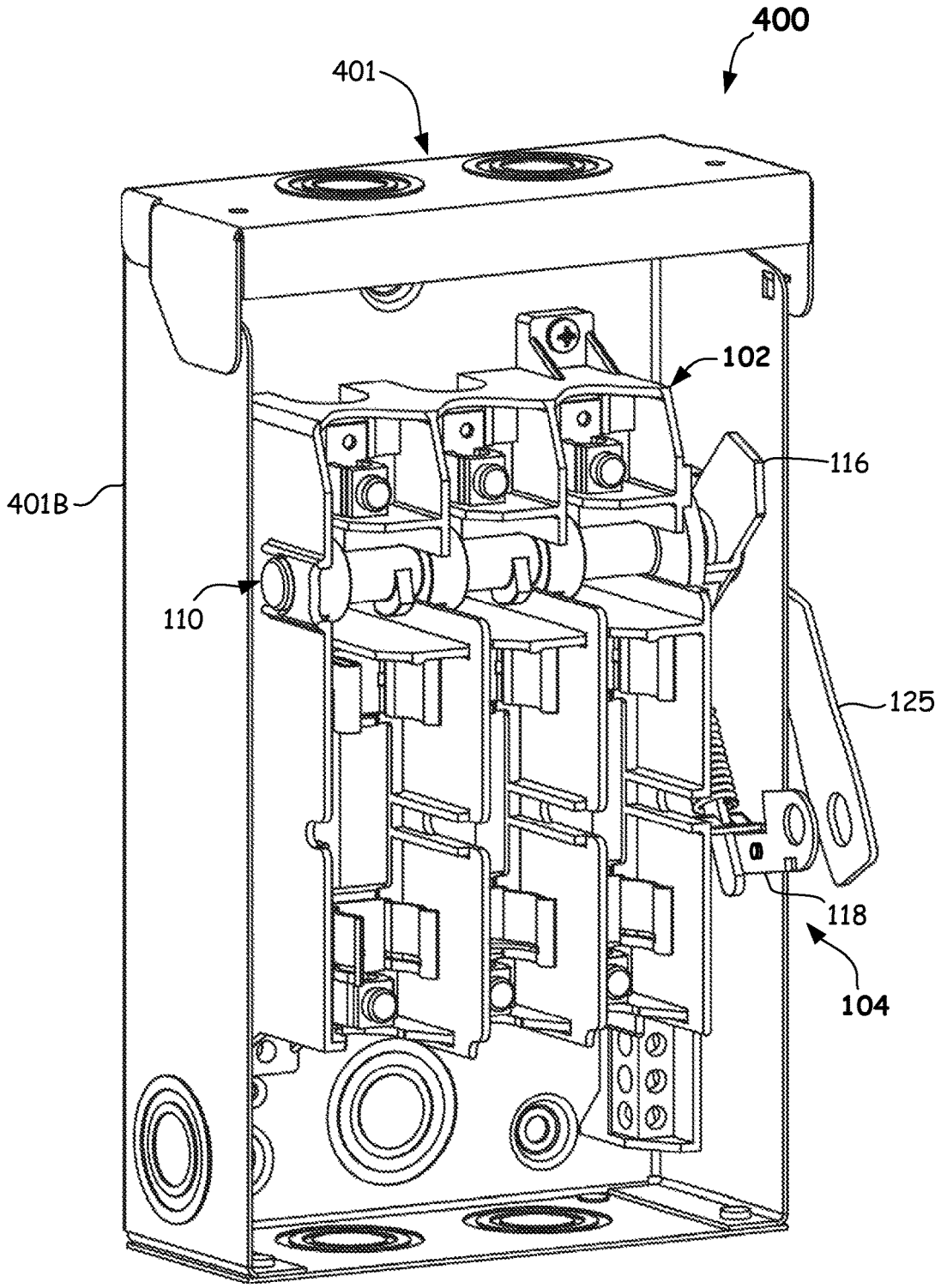
FIG. 4C illustrates a perspective view of an enclosed switch assembly with the lid removed for illustration purposes according to one or more embodiments.
Figure 5A:
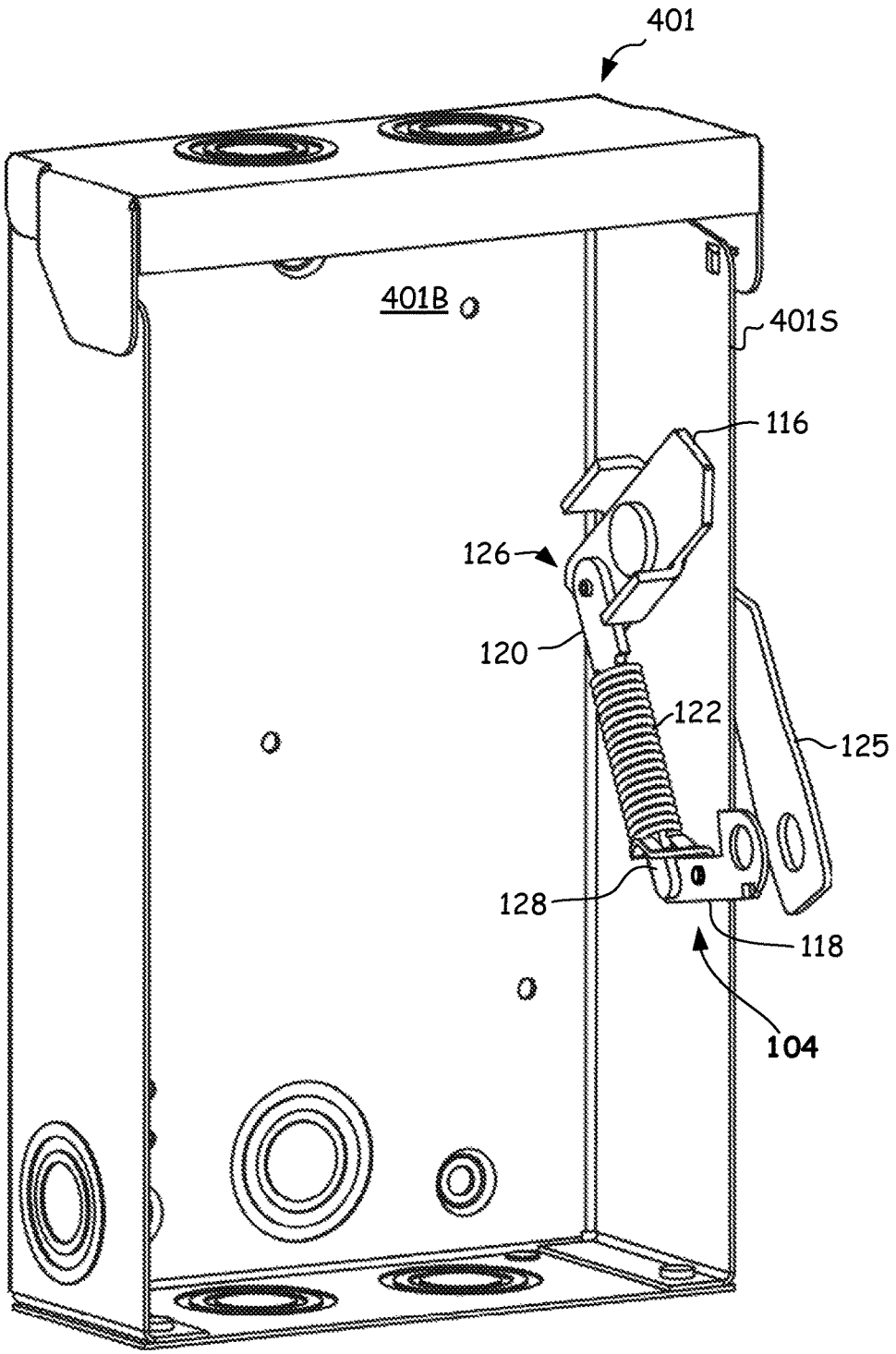
FIG. 5A illustrates a perspective view diagram of switch box mechanism coupled to the enclosure according to one or more embodiments.
Figure 5B:
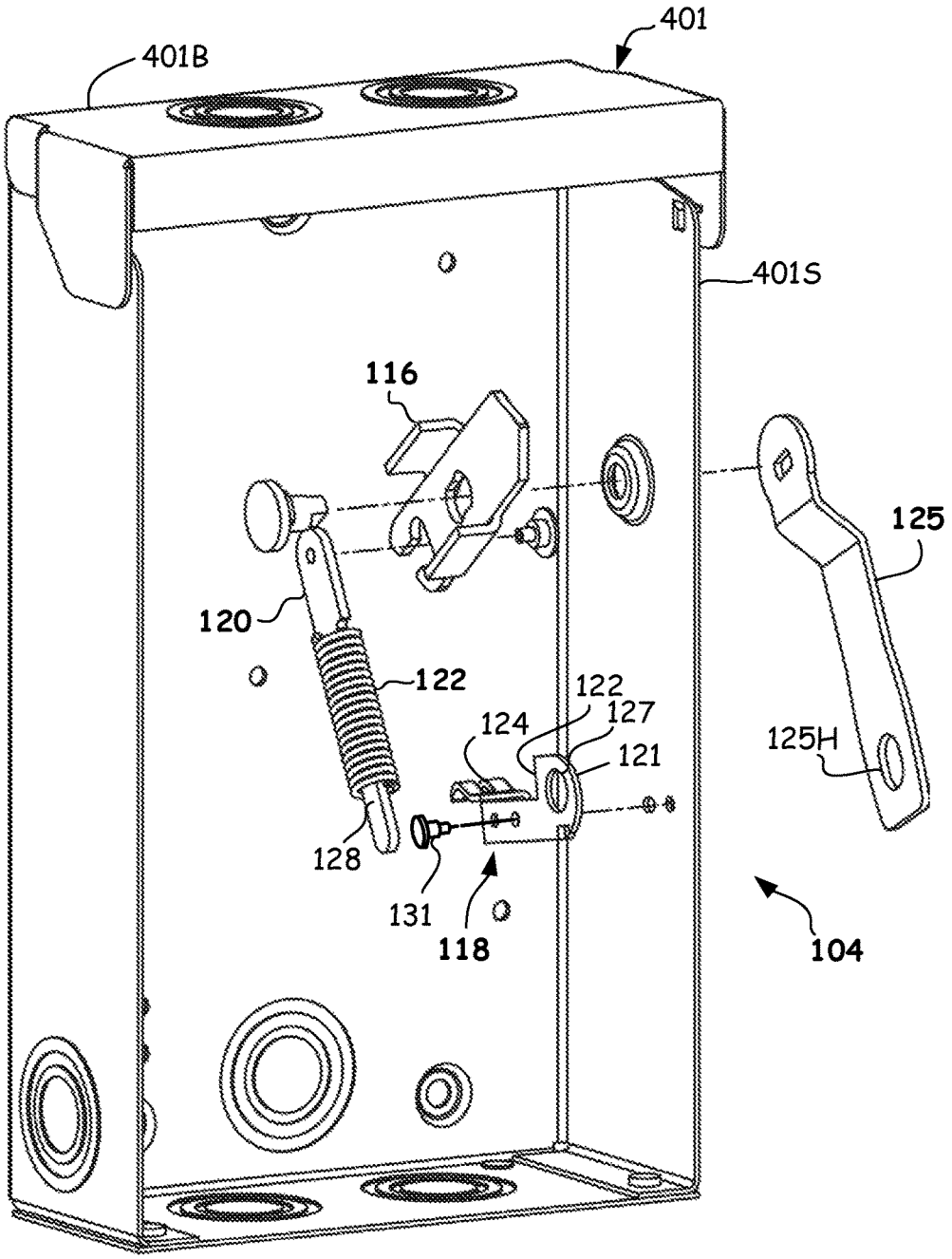
FIG. 5B illustrates an exploded view diagram of a switch box mechanism according to one or more embodiments.
Figure 6:
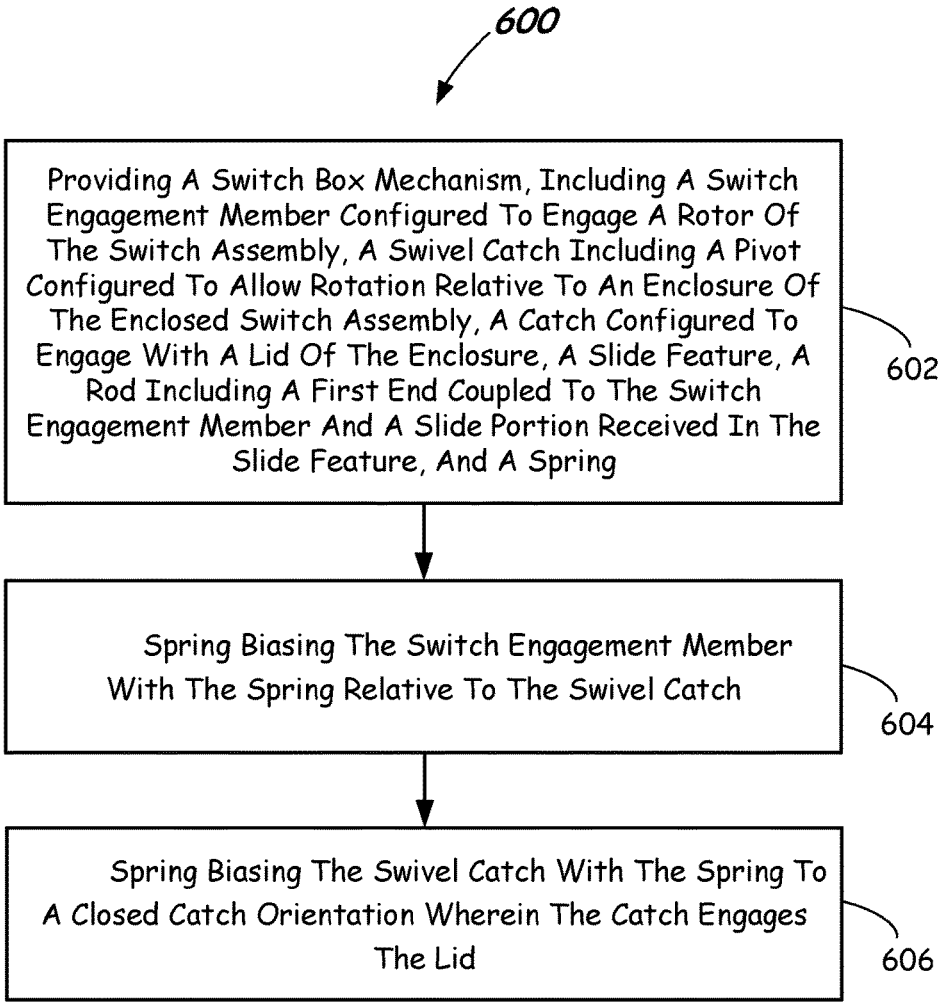
FIG. 6 is a flowchart of a method of operating an enclosed switch assembly according to embodiments.

FIG. 1 illustrates an embodiment of a switch subassembly 100 configured to be a subcomponent of an enclosed switch assembly 400 (FIGS. 4A-4C). The switch subassembly 100 may be used within an enclosure 401 to allow QMQB or spring bias of a switch including electrical contacts embodied therein. The switch subassembly 100 is made up of a line base assembly 102 and switch box mechanism 104. The line base assembly 102 includes features allowing electrical connection to terminal components thereof. Within the line base assembly 102, power may be provided to the line-side terminals of a line base 106, such as to A, B, and C phase terminals 108A, 108B, and 108C thereof. Line-side terminals 108A, 108B, 108C may be captivated or otherwise provided in a fixed location within a molded base 107, which may be made of a non-conductive material, such as a plastic material. Another side of the line base 106 may include load-side terminals 112A, 112B, and 112C of the enclosed switch assembly 400. These load-side terminals 112A-112C may be connected directly to the load, and may also be may be captivated or otherwise provided in a fixed location within the molded base 107. Any suitable terminal configuration may be used for the line-side terminals 108A, 108B, and 108C and the load-side terminals 112A-112C. Moreover, any suitable construction of the line base assembly 102 may be used.

In some embodiments, such as shown herein, the line base 106 may optionally configured to receive fuse members, such pull-out fuses (fuses not shown in FIG. 1) in the current path for each phase present. If fuses are included, the line base 106 may include line-side fuse clips 109A-109C and load-side fuse clips 111A-111C, that are configured to be coupled to the respective electrically-conductive ends of the pull-out fuses (not shown), which may be provided in the current path of the phases (e.g., A, B, and C phases), for example. Any suitable fuses may be used. Fuses may have fuse ratings of about 16 A to 1,600 A, for example. The voltage rating may be up to about 1,000V, or even between about 120V to about 600V in some embodiments, for example. Class R or T fuses may be used, for example. Other types of pull-out fuses may be used. Further, although shown as a three-pole version herein, in some embodiments, the switch within the enclosure may be a two-pole version and may include only A and C phases, or may even be a single-pole version, wherein single phase operation is provided. Furthermore, the switch box mechanism 104 may be applicable to other enclosed switch subassemblies and devices having an enclosure with lid and an operating handle, such as panel boards, bus plugs, circuit breaker enclosures, bail arm switches, and the like. As will be apparent, the switch box mechanism 104 may be readily adapted to such subassemblies and devices.

In more detail, the switch subassembly 100, comprises an electrical engagement member, such as a rotor 110, received in the molded base 107 and configured to be relatively-freely rotatable therein, i.e., rotatable with relatively little friction when excepting the spring bias. The configuration of the switch and electrical engagement member may be of any form enabling connection and disconnection of the electrical load. In the depicted embodiment, the electrical engagement member (the rotor 110) may include one or more electrical switch components, such as conductive blades 113A-113C (only one side shown) extending through an insulating body, wherein each of the ends of the conductive blades 113A-113C are moveable and engagable with first electrical contact components, which may be part of, or interconnected to, the respective line-side terminals 108A-108C, and second electrical contact components, which may be part of or interconnected to line-side fuse clips 109A-109C in fused embodiments. Optionally, the second electrical contact components may be part of, or interconnected to, the load-side terminals 112A-112C in non-fused switch embodiments.

Thus, rotation of the electrical engagement member (e.g., the rotor 110) via initiation of the closing operation by the operating handle 125 causes engagement between the conductive blades 113A-113C and the first and second electrical contact components and thereby closes the switch. The actual opening and closing, once initiated, may be caused by the switch box mechanism 104, as described herein. Likewise, movement of the operating handle 125 in the opposite direction initiates disengagement between the conductive blades 113A-113C and the first and second electrical contact components whereas the QMQB function or spring bias provided by the switch box mechanism 104 opens the switch. The rotor 110 may include any suitable construction that allows electrical switch connection/disconnection via rotation thereof, such as including one or more rotatable blades that may be rotatable about a center thereof, for example, or even about an end thereof, like a bail arm. The term "rotor" as used herein means a rotating conductor configured to engage one or more other electrical contacts or terminal portions in order to open or close an electrical conduction path there through.

The rotor 110 may further include, at one end any suitable engagement mechanism, such as mechanism engagement member 114. The switch box mechanism 104 is configured and operable to engage with the mechanism engagement member 114 of the electrical engagement member (e.g., rotor 110) and cause rotation thereof. In particular, the switch box mechanism 104 may not only enable the QMQB capability of the switch (or just spring biasing) of the rotor 110, but also provides lid catch/retention capability, as will be further described herein. The switch box mechanism 104 is made up of interconnecting componentry including a swivel catch 118, a rod 120, and a spring 123.

Figure 3A:
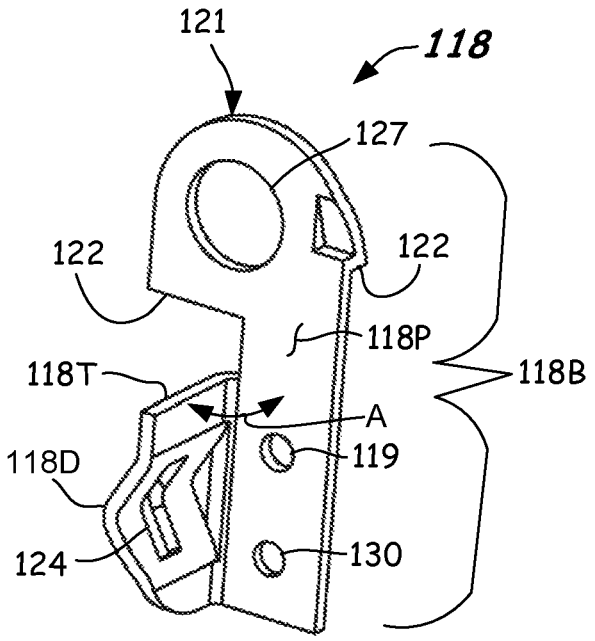
FIG. 3A illustrates a perspective view of a swivel catch of the switch box mechanism according to one or more embodiments.
Figure 3B:
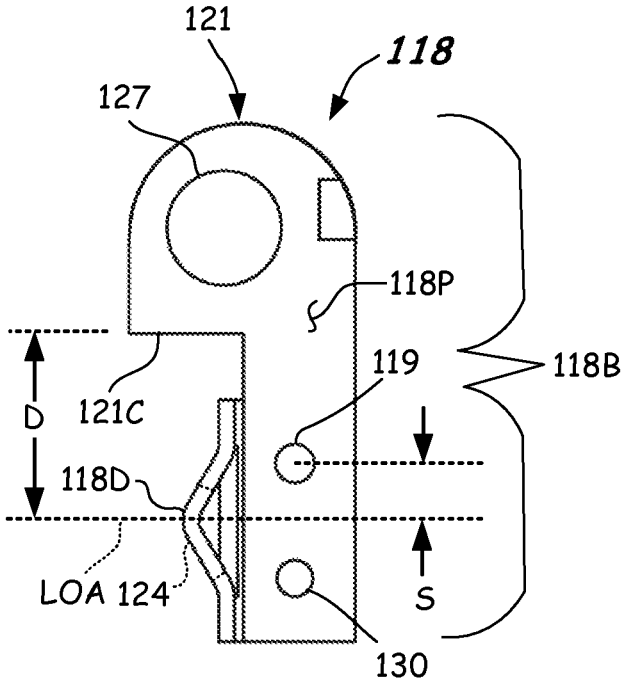
FIG. 3B illustrates a side plan view of a swivel catch according to one or more embodiments.
Figure 3C:
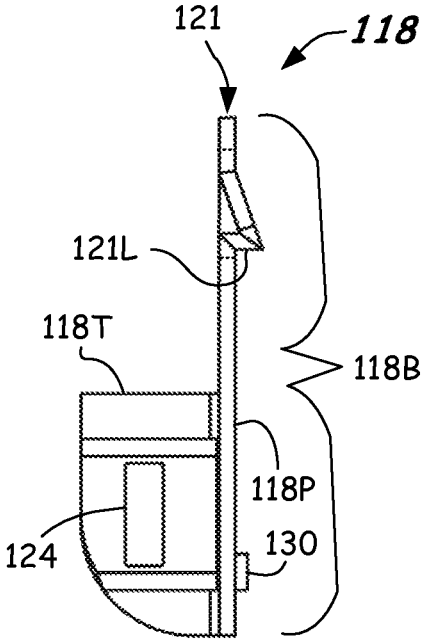
FIG. 3C illustrates a front plan view of a swivel catch according to one or more embodiments.

Referring now to FIGS. 2A-2B and FIGS. 3A-3C, the switch box mechanism 104 and components thereof will be described in detail. As best shown in FIGS. 3A-3C, the swivel catch 118 includes an elongated body 118B, a pivot 119 configured to allow the swivel catch 118 to rotate, and a catch end 121. The catch end 121 may include a catch 121C (e.g., a flat surface, or the like) configured and operable to engage with a surface or feature of a lid (lid 401L—FIG. 4A) such as a slot formed there through the lid 401L, and a slide feature 124 formed in the elongated body 118B. A lateral catch 121L may further be formed on the catch end 121 on a side of the swivel catch 118 opposite the slide feature 124. The lateral catch 121L is operable as a supplement to secure the lid 401L, but is optional. In the depicted embodiment, the elongated body 118B may comprise a planar portion 118P (e.g., a planar surface) extending along a length thereof and a tab (118T extending substantially perpendicularly (e.g., within +/−20 degrees of angle A of 90 degrees—See FIG. 3A) from a planar surface the planar portion 118P, and wherein the slide feature 124 (e.g., the slot) is formed through a tab 118T. Other angles may be used if the slide feature 124 were enlarged in comparison to the size of the rod 120.

The slot may include a rectangular shape in plan view (FIG. 3C), however other shapes are possible. Further, the slot may be formed through a bend 118D formed in the tab 118T. The tab 118T may extend from the planar portion 118P away from the sidewall 401S of the enclosure 401 (See FIG. 5B).

The pivot 119 of the elongated body 118B may comprise an aperture (e.g., a round hole) that is configured to receive a pivot pin 131 therein, which may be embodied as a shoulder rivet. Pivot pin 131 may be received through pivot 119 and may be staked or otherwise securely fastened to the sidewall 401S of the enclosure body 401B to allow substantially free rotation of the swivel catch 118 relative to the enclosure 401, excepting the spring bias provided by the spring 123. In alternate embodiments, the swivel catch 118 may pivot on the molded base 107.

In order to spring bias the swivel catch 118 so that it may retain the lid 401L, the aperture comprising the pivot 119 may be located between a line of action LOA of the rod 120 in sliding feature 124 and the location of the catch 122. The LOA is the location of the rod 120 as it passes through the sliding feature 124 (e.g., through the slot). For example, the spacing S may be between about 3 mm and about 10 mm and the distance D between the LOA and the catch 122 may be about 10 mm to about 30 mm. Other values may be used. The distance S and D may be selected to provide about a 5 pounds (22 N) retaining force at the catch 121C that has to be overcome in order to open and release the lid 401L.

The elongated body 118B of the swivel catch 118 may include a lock-out hole 127 formed through the catch end 121 thereof. The lock-out hole 127 may be aligned with a second lock-out hole 125H formed through the operating handle 125 when the operating handle 125 is rotated to a lock-out configuration (i.e., where the switch is open). A locking member 129 may be inserted through both of the lock-out hole 127 and the second lock-out hole 125H to prevent the operating handle 125 from being moved to a closed orientation wherein the switch is closed. Locking member 129 may be a padlock, other lock, lock-out tag, or the like, wherein a portion of a padlock being shown as the locking member 129 in FIG. 2A. Thus, lock-out is achieved when the lock-out hole 127 and the second lock-out hole 125H are aligned laterally to allow a locking member 129 to be received there through in a lock-out configuration. The swivel catch 118 may include a detent 130 formed therein. The detent 130 may be a stamped riser (See FIG. 3) or other feature that operates to engage with a slot or other structural feature on the enclosure to limit the rotational motion of the swivel catch 118 to a predefined limited extent.

Again referring to FIG. 2A-2B, the first end 126 of the rod 120 may comprise a shoulder pin 133 that couples to the switch engagement member 116. The shoulder pin 133 may be received in an open-sided slot 134 formed in the switch engagement member 116. The operating handle 125 is coupled to the switch engagement member 116 by handle securing mechanism 135. Further discussion of the engagement of the switch engagement member 116 with the mechanism engagement member 114 of the rotor 110 of the line base assembly 102, as well as the connection of the switch engagement member 116 and the operating handle 125 by way of the handle securing mechanism 135 can be found in U.S. patent application Ser. No. 15/701,898, entitled "Electrical Switch Methods And Apparatus," contemporaneously-filed herewith, the disclosure of which is hereby incorporated by reference herein in its entirety for all purposes.

The switch box mechanism 104 may also include a switch engagement member 116 that is configured to engage with the rotor 110 of the line base assembly 102, such as by engaging with the mechanism engagement member 114. Further, the switch box mechanism 104 may include the operating handle 125 configured to rotate the switch engagement member 116 and, at least initially, the rotor 110 until the QMQB functionality takes over and finalizes rotation of the rotor 110 to either the fully-opened or fully-closed orientation.

The rod 120 includes a first end 126 that is configured to couple to the switch engagement member 116, which in turn is configured to engage with the rotor 110 of the line base assembly 102. Further, the rod 120 includes a slide portion 128 that is configured to be slidably engaged with the slide feature 124, and may reciprocate therein as shown, as the switch is moved through its range of motion. The slide feature 124 may comprise a slot, for example. However a cylindrical rod and round hole configuration may optionally be used. A loose slip fit may be provided between the slide portion 128 and the slide feature 124. The rod 120 may be a stamped metal (e.g., steel) component and may have a rectangular cross-section, as shown. Likewise, the swivel catch 118, operating handle 125 and the switch engagement member 116 may be a stamped and bent metal (e.g., steel) components. The rod 120 may be enlarged at the first end 126 and may include one or more steps 120S formed thereon that are configured to allow compression of the spring 123 against the swivel catch 118, and wherein the spring 123 may comprise a coil spring surrounding a portion of the rod 120 between the first end 126 and the slide portion 128.

The spring 123 may be received over the outside of rod 120 and is configured to spring bias the swivel catch 118 to an orientation where the catch 122 engages with and catches the lid 401L (See the closed catch orientation in FIG. 4A). The spring 123 also spring biases the switch engagement member 116 and rotor 110 to enable the quick-make and quick-break (QMQB) function. The spring 123 may be a coil spring and may be received over a portion of the rod 120. The spring 123 may have a compression spring rate of about 15 lb./in (26 N/cm) to about 30 lb./in (53 N/cm), for example. Other types, configurations, and spring rates of the spring 123 may be used.

In another aspect, a method 600 of operating an enclosed switch assembly (e.g., enclosed switch assembly 400) is provided. The method 600 includes, in 602, providing a switch box mechanism (e.g., switch box mechanism 104), including a switch engagement member (e.g., switch engagement member 116) configured to engage a rotor (e.g., rotor 110) of the enclosed switch assembly, a swivel catch (e.g., swivel catch 118) including a pivot (e.g., pivot 119) configured to allow rotation relative to an enclosure (e.g., enclosure 401) of the enclosed switch assembly, a catch (e.g., catch 122) configured to engage with a lid (e.g., lid 401L) of the enclosure, a slide feature (e.g., slide feature 124), a rod (e.g., rod 120) including a first end (e.g., first end 126) coupled to the switch engagement member and a slide portion (e.g., slide portion 128) received in the slide feature, and a spring (e.g., spring 123).

The method 600 includes, in 604, spring biasing the switch engagement member with the spring relative to the swivel catch. This spring bias enables the provision of quick-make and quick-break (QMQB) in some embodiments, or may simply provide a spring bias or spring assist in opening or closing of the switch.

The method 600 includes, in 604, spring biasing the swivel catch with the spring to a closed catch orientation (see FIGS. 4A-4C) wherein the catch (e.g., catch 122) engages the lid (e.g., lid 401L).

It should be readily appreciated by those persons of ordinary skill in the art that the present invention is susceptible of broad utility and application. Many embodiments and adaptations of the present disclosure other than those herein described, as well as many variations, modifications, and equivalent arrangements, will be apparent from, or reasonably suggested by, the present invention and the foregoing description thereof, without departing from the substance or scope thereof. Accordingly, while the present invention has been described herein in detail in relation to specific embodiments, it is to be understood that this disclosure is only illustrative and presents examples of the present invention and is made merely for purposes of providing a full and enabling disclosure of the invention. This disclosure is not intended to limit the invention to the particular apparatus, assemblies, and/or methods disclosed, but, to the contrary, the intention is to cover all modifications, equivalents, and alternatives falling within the scope of the claims.

What is claimed is:

1. A switch box mechanism, comprising:

a swivel catch having an elongated body, a pivot configured to allow the swivel catch to rotate, and a catch end, the catch end including a catch configured to engage with a lid, and a slide feature formed in the elongated body;

a rod including a first end configured to couple to a switch engagement member that is configured to engage with a rotor of a line base assembly, and a slide portion of the rod slidably engaged with the slide feature; and a spring configured to bias the swivel catch, wherein the catch end of the elongated body of the swivel catch including a lock-out hole therethrough and a second lock-out hole formed through an operating handle such that the swivel catch is mounted in such a way that the lock-out hole aligns with the second lock-out hole in an off position which allows a lock to be placed through the swivel catch and the operating handle while a gap between the swivel catch and the operating handle allows the lock to pass only through the swivel catch and not the operating handle thus providing a cover lock-out function in that an enclosure is locked with the lock without locking the operating handle.

2. The switch box mechanism of claim 1, wherein the slide feature comprises a slot.

3. The switch box mechanism of claim 2, wherein elongated body comprises a planar portion and a tab extending substantially perpendicularly from the planar portion, and wherein the slot is formed through a tab.

4. The switch box mechanism of claim 3, wherein the slot is formed through a bend in the tab.

5. The switch box mechanism of claim 1, wherein the elongated body comprises a planar portion and a tab extending substantially perpendicularly from the planar portion.

6. The switch box mechanism of claim 1, comprising a lock-out hole through the catch end of the elongated body, and a second lock-out hole through an operating handle, wherein the lock-out hole and the second lock-out hole are aligned laterally to allow a locking member to be received there through in a lock-out configuration.

7. The switch box mechanism of claim 1, comprising a detent.

8. The switch box mechanism of claim 1, wherein the pivot comprises an aperture configured to receive a pivot pin.

9. The switch box mechanism of claim 8, wherein the aperture is located between a line of action of the rod and the catch.

10. The switch box mechanism of claim 1, further comprising a lateral catch formed on the catch end on a side of the swivel catch opposite the slide feature.

11. The switch box mechanism of claim 1, wherein the first end of the rod comprises a shoulder pin that couples to the switch engagement member.

12. The switch box mechanism of claim 11, wherein the shoulder pin is received in an open-sided slot the switch engagement member.

13. The switch box mechanism of claim 1, wherein the rod comprises at least one step on the first end configured to allow compression of the spring against the swivel catch.

14. The switch box mechanism of claim 1, wherein spring comprises a coil spring surrounding a portion of the rod between the first end and the slide portion.

15. The switch box mechanism of claim 1, wherein spring contacts a tab of the swivel catch and biases the swivel catch to a closed orientation.

16. A switch subassembly, comprising:

a line base assembly including a line base, and a rotor received in the line base and configured to be rotatable therein, the rotor including one or more electrical switch components; and a switch box mechanism, including:

a switch engagement member configured to engage with the rotor of the line base assembly, a swivel catch having an elongated body, a pivot configured to allow the swivel catch to rotate, and a catch end, the catch end including a catch configured to engage with a lid of an enclosure, and a slide feature formed on the elongated body, a rod including a first end coupled to the switch engagement member, and a slide portion received in the slide feature, and a spring biasing the switch engagement member, the spring further biasing the swivel catch to a closed catch orientation, wherein the catch end of the elongated body of the swivel catch including a lock-out hole therethrough and a second lock-out hole formed through an operating handle such that the swivel catch is mounted in such a way that the lock-out hole aligns with the second lock-out hole in an off position which allows a lock to be placed through the swivel catch and the operating handle while a gap between the swivel catch and the operating handle allows the lock to pass only through the swivel catch and not the operating handle thus providing a cover lock-out function in that the enclosure is locked with the lock without locking the operating handle.

17. An enclosed switch assembly, comprising:

an enclosure including an enclosure body and a lid on the enclosure body; and a switch subassembly mounted to the enclosure body, the switch subassembly comprising:

a line base assembly including a line base coupled to the enclosure body, and a rotor received in the line base and configured to be rotatable therein, the rotor including one or more electrical switch components; and a switch box mechanism, including:

a switch engagement member configured to engage with the rotor, a swivel catch having an elongated body, a pivot configured to allow the swivel catch to rotate relative to the enclosure, and a catch end including a catch configured to engage with the lid, and a slide feature formed on the elongated body, a rod including a first end coupled to the switch engagement member, and a slide portion received in the slide feature, and a spring biasing the switch engagement member, the spring further biasing the swivel catch to a closed catch orientation wherein the catch engages the lid, wherein the catch end of the elongated body of the swivel catch including a lock-out hole therethrough and a second lock-out hole formed through an operating handle such that the swivel catch is mounted in such a way that the lock-out hole aligns with the second lock-out hole in an off position which allows a lock to be placed through the swivel catch and the operating handle while a gap between the swivel catch and the operating handle allows the lock to pass only through the swivel catch and not the operating handle thus providing a cover lock-out function in that the enclosure is locked with the lock without locking the operating handle.

18. The switch box mechanism of claim 1, wherein the spring biases the switch engagement member and the rotor to enable a quick-make and quick-break (QMQB) function such that the switch box mechanism not only enables the QMQB function of a switch of the rotor, but also provides a retention capability to catch the lid.

* * * * *